US005278037A

United States Patent [19]

Karino

[11] Patent Number: 5,278,037

[45] Date of Patent: Jan. 11, 1994

[54] SILVER HALIDE PHOTOGRAPHIC LIGHT-SENSITIVE MATERIAL

[75] Inventor: Yukio Karino, Kanagawa, Japan

[73] Assignee: Fuji Photo Film Co., Ltd., Kanagawa, Japan

[21] Appl. No.: 873,157

[22] Filed: Apr. 24, 1992

[30] Foreign Application Priority Data

Apr. 25, 1991 [JP] Japan ..... 3-121749

[51] Int. Cl.[5] ..... G03C 1/492

[52] U.S. Cl. ..... 430/513; 430/514; 430/515; 430/516; 430/517

[58] Field of Search ..... 430/517, 513, 514, 515, 430/516

[56] References Cited

U.S. PATENT DOCUMENTS 4,506,002 3/1985 Takaki et al. ..... 430/517
4,614,708 9/1986 Timmerman et al. ..... 430/517
4,952,484 8/1990 Katoh et al. ..... 430/517
5,098,818 3/1992 Ito et al. ..... 430/517
5,098,820 3/1992 McManus ..... 430/517
5,155,015 10/1992 Jimbo ..... 430/517

*Primary Examiner*—Jack P. Brammer
*Attorney, Agent, or Firm*—Sughrue, Mion, Zinn, Macpeak & Seas

[57] ABSTRACT

There is disclosed a silver halide photographic light-sensitive material containing a dye which can be decolored or eluted without causing a stain problem attributable to a residual color, wherein the light-sensitive material comprises a support, having provided thereon at least one light-sensitive silver halide emulsion layer and at least one hydrophilic colloid layer containing a dispersed solid form of a dye, wherein the dye is dispersed in fine particles with an anionic polymer.

13 Claims, No Drawings

SILVER HALIDE PHOTOGRAPHIC LIGHT-SENSITIVE MATERIAL

FIELD OF THE INVENTION

The present invention relates to a silver halide photographic light-sensitive material, specifically to a silver halide photographic light-sensitive material comprising at least one hydrophilic colloid layer containing a dye which can be favorably incorporated into a light-sensitive material and bleached and/or eluted by a developing treatment so that a stain by a residual color is not generated.

BACKGROUND OF THE INVENTION

In general, in a silver halide photographic light-sensitive material, the incorporation of light absorbing compounds into a silver halide emulsion layer or other hydrophilic colloid layers has been carried out in order to absorb a light of a specific wavelength in order to achieve sensitivity adjustment, improvement in safety of safelight, color temperature adjustment of light, prevention of halation, and adjustment of sensitivity balance in a multilayered color light-sensitive material.

For example, when a silver halide photographic light-sensitive material, which comprises a support and hydrophilic colloid layers such as a light-sensitive silver halide emulsion layer, is subjected to imagewise exposure in order to record an image on the light-sensitive silver halide emulsion layer, it is necessary to control the spectral composition of light incident to the silver halide emulsion layers in order to improve photographic sensitivity. In this instance, usually a method is employed in which a dye, which is capable of absorbing light of a wavelength unnecessary for the above silver halide emulsion layer, is incorporated into the hydrophilic colloid layers farther from the support than the above light-sensitive silver halide emulsion layer to form a filter layer and only light of a desired wavelength is transmitted.

For the purpose of improving image sharpness, an anti-halation layer is provided between a light-sensitive layer and a support or on the backside of the support to absorb harmful reflected light at the interface between the emulsion layer and support or on the backside of the support.

Further, a dye capable of absorbing light of a wavelength region in which silver halide is sensitive is used on some occasions for a silver halide emulsion layer for the purpose of preventing irradiation in order to improve the sharpness of an image.

Particularly, a silver halide photographic light-sensitive material used for a plate making process, more specifically a light-sensitive material used in a light room, contains a dye absorbing UV rays and visible rays in a light-sensitive layer or a layer present between the light source and light-sensitive layer in order to increase the safety against the safe-light.

Further, in an X-ray sensitive material, a coloring layer is provided on some occasions to improve sharpness, which serves as a crossover cutting filter for decreasing crossover rays.

These coloring layers consist of hydrophilic colloid in many cases and, therefore, a dye is usually incorporated into the layers for coloring. The inventor sought dyes having the following characteristics:

(1) an appropriate spectral absorption according to its uses and purposes;

(2) photochemical inactivity, i.e., not exerting negative chemical effects on a silver halide photographic layer, e.g., lowering of sensitivity, degradation of the latent image, and fogging;

(3) an ability to be bleached, dissolved and removed in photographic processing steps without leaving harmful color on the processed photographic light-sensitive material; and (4) an excellent aging stability in a coating liquid (solution) or a silver halide photographic material without a change in quality.

Many efforts have been made in order to discover dyes satisfying these conditions.

Where the layers containing the dyes function as a filter layer and an anti-halation layer, it is preferred that the layers concerned are selectively colored and the other layers are not substantially colored, because if the other layers also are substantially colored, not only is a harmful spectral effect exerted but also the effectiveness as a filter layer and an anti-halation layer are reduced.

Many means have been investigated, and it has been proposed to fix a dye in a specific layer in a photographic light-sensitive material by incorporating the dyes in a dispersed solid form, as disclosed in JP-A-56-12639 (the term "JP-A" as used herein means an unexamined published Japanese patent application}, JP-A-55-155350, JP-A-55-155351, JP-A-52-92716, JP-A-63-197943, JP-A-63-27838, and JP-A-64-40827, EP-B-15601 and EP-A-276566, and WO88/04794.

In the above publications, the dyes are generally dispersed in solid form (a dye solid particle dispersion) with anionic surface active agents (a wetting agent), e.g., sodium oleyl methyltauride is disclosed as a dispersant in JP-A-52-92716 and Triton X200® is disclosed as a dispersant in W088/04794.

However, where the dyes are dispersed in solid form as described above, the stability of the dispersion is deteriorated depending on the dispersants selected which immediately cause settling and flocculating, and when the dyes are mixed with a hydrophilic colloid, they flocculate to form a lump or the apparent absorbance is lowered. Further, the particle size of the dye dispersed in a solid form does not become small and the broadening of the absorption spectrum in the coated layer takes place.

Accordingly, the selection of a dispersant which has an improved dispersing property and which has less of a negative effect against photographic properties was sought by the inventor who has now found the preferable combination of a dye and a dispersant.

SUMMARY OF THE INVENTION

Accordingly, the first object of the present invention is to provide a silver halide photographic light-sensitive material in which a hydrophilic colloid layer is colored by a dye which is irreversibly bleached in photographic processing and which does not negatively affect the photographic properties of an emulsion.

The second object of the present invention is to provide a silver halide photographic light-sensitive material having a hydrophilic colloid layer containing a dispersed solid form of a dye, which is improved in stability of the dispersion.

The third object of the present invention is to provide a silver halide photographic light-sensitive material having at least one layer colored with a dye having a controlled interaction with gelatin and a coating aid and an improved coating property.

As the result of intensive investigations, it has been found by the present inventor that the above and other objects and advantages can be achieved by a silver halide photographic light-sensitive material comprising a support, having provided thereon at least one light-sensitive silver halide emulsion layer and at least one hydrophilic colloid layer containing a dispersed solid form of a dye, wherein the dye is dispersed in fine particles with an anionic polymer.

DETAILED DESCRIPTION OF THE INVENTION

The compounds represented by the following Formulas (I) to (VII) and the compounds shown in Tables I to X of WO88/04794 are examples of a useful dispersed solid form of the dye:

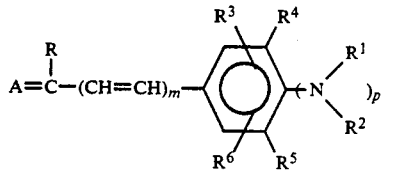

Formula (I)

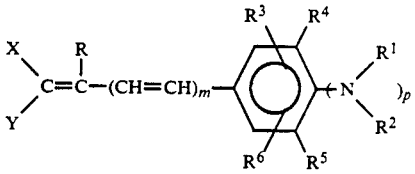

Formula (II)

$A{=}L_1{-}(L_2{=}L_3)_n{-}A'$ Formula (III)

$A{=}(L_1{-}L_2)_{2-q}{=}B$ Formula (IV)

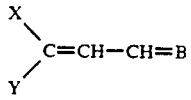

Formula (V)

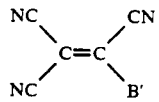

Formula (VI)

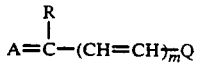

Formula (VII)

wherein A and A' may be the same or different and each represents an acidic nucleus; B represents a base nucleus; X and Y may be the same or different and each represents an electron attractive group; R represents a hydrogen atom or an alkyl group; $R_1$ and $R_2$ may be the same or different and each represents an alkyl group, an aryl group, an acyl group or a sulfonyl group, and $R_1$ and $R_2$ may be combined with each other to form a 5 or 6-membered ring; $R_3$ and $R_6$ may be the same or different and each represents a hydrogen atom, a hydroxy group, a carboxyl group, an alkyl group, an alkoxy group, or a halogen atom; $R_4$ and $R_5$ may be the same or different and each represents a hydrogen atom or a group of non-metallic atoms necessary for $R_1$ and $R_4$ or $R_2$ and $R_5$ to combine to form a 5 or 6-membered ring; $L_1$, $L_2$ and $L_3$ each represents a methine group; m represents 0 or 1; n and q each represents 0, 1 and 2; p represents 0 and 1, provided that when p is 0, $R_3$ represents a hydroxy group or a carboxyl group and $R_4$ and $R_5$ each represents a hydrogen atom; B' represents a carboxyl group, a sulfamoyl group or a heterocyclic group having a sulfonamido group; Q represents a heterocyclic group; and provided that the compounds represented by Formulas (I) to (VII) have at least one dissociative group in one molecule, wherein the pKa of the dissociative group ranges from 4 to 11 in a mixed solvent of water and ethanol in a ratio by volume of 1:1.

The compounds represented by Formulas (I) to (VII) will be explained in detail below.

The acidic nucleus represented by A or A' is preferably 2-pyrazoline-5-one, rhodanine, hydantoin, thiohydantoin, 2,4-oxazolidinedione, isoxazolidinone, barbituric acid, thiobarbituric acid, indandione, pyrazolopyridine, or hydroxypyridone.

The base nucleus represented by B is preferably pyridine, quinoline, indolenine, oxazole, benzoxazole, naphthoxazole, or pyrrole.

Examples of the heterocyclic group represented by B' include pyrrole, indole, thiophene, furan, imidazole, pyrazole, indolidine, quinoline, carbazole, phenothiazine, phenoxazine, indoline, thiazole, pyridine, pyridazine, thiadiazine, pyran, thiopyran, oxadiazole, benzoquinolizine, thiadiazole, pyrrolothiazole, pyrrolopyridazine, and tetrazole.

The heterocyclic group represented by Q is preferably a 5-membered hetero ring with which a benzene ring may be condensed, more preferably a 5-membered nitrogen-containing hetero ring with which a benzene ring may be condensed. The examples of the hetero ring represented by Q are pyrrole, indole, pyrazole, pyrazolopyrimidone, and benzoindole.

The group having a dissociative proton with a pKa (an acid dissociation constant) which ranges from 4 to 11 in a mixed solvent of water and ethanol in a ratio by volume of 1:1 has no specific limits as to the kind and substitution position thereof on the dye molecule as long as the group makes the dye molecule substantially water insoluble at pH of 6 or lower and makes the dye molecule substantially water soluble at pH of 8 or higher. Preferably, the group is a carboxyl group, a sulfamoyl group, a sulfonamido group, or a hydroxy group, and more preferably a carboxyl group. The dissociative group is not only directly substituted on the dye molecule but also may be substituted thereon via a divalent linkage group (for example, an alkylene group and a phenylene group). Examples of the dissociative group substituted on the dye molecule via the divalent linkage group include 4-carboxyphenyl, 2-methyl-3-carboxyphenyl, 2,4-dicarboxyphenyl, 3,5-dicarboxyphenyl, 3-carboxyphenyl, 2,5-dicarboxyphenyl, 3-ethylsulfamoylphenyl, 4-phenylsulfamoylphenyl, 2-carboxyphenyl, 2,4,6-trihydroxyphenyl, 3-benzenesulfonamidphenyl, 4-(p-cyanobenzenesulfonamido)phenyl, 2-hydroxyphenyl, 3-hydroxyphenyl, 4-hydroxyphenyl, 2-hydroxy-4-carboxyphenyl, 3-methoxy-4-carboxyphenyl, 2-methyl-4-phenylsulfamoylphenyl, 4-carboxybenzyl, 2-carboxybenzyl, 3-sulfamoylphenyl, 4-sulfamoylphenyl, 2,5-disulfamoylphenyl, carboxymethyl, 2-carboxyethyl, 3-carboxypropyl, 4-carboxybutyl, and 8-carboxyoctyl.

The alkyl group represented by R, $R_3$ or $R_6$ is preferably an alkyl group having 1 to 10 carbon atoms, (for example, methyl, ethyl, n-propyl, isoamyl, and n-octyl).

The alkyl group represented by $R_1$ or $R_2$ is preferably an alkyl group having 1 to 20 carbon atoms (for example, methyl, ethyl, n-propyl, n-butyl, n-octyl, n-octadecyl, isobutyl, and isopropyl) and may have a substituent (for example, a halogen atom such as chlorine and bromine, a nitro group, a cyano group, a hydroxy group, a carboxy group, an alkoxy group such as methoxy and ethoxy, an alkoxycarbonyl such as methoxycarbonyl and isopropoxycarbonyl, an aryloxy group such as a phenoxy group, a phenyl group, an amido group such as acetylamino and methanesulfonamido, a carbamoyl group such as methylcarbamoyl and ethylcarbamoyl, and a sulfamoyl group such as methylsulfamoyl and phenylsulfamoyl.

The aryl group represented by $R_1$ or $R_2$ is preferably a phenyl group or a naphthyl group and may have a substituent. Examples of the substituent include groups which are given as the substituent for the alkyl group represented by $R_1$ or $R_2$, as well an alkyl group such as methyl and ethyl.

The acyl group represented by $R_1$ or $R_2$ is preferably an acyl group having 2 to 10 carbon atoms, (for example, acetyl, propionyl, n-octanoyl, n-decanoyl, isobutanoyl, and benzoyl).

The sulfonyl group represented by $R_1$ or $R_2$ preferably includes an alkylsulfonyl group or an arylsulfonyl group (for example, methanesulfonyl, ethanesulfonyl, n-butanesulfonyl, n-octanesulfonyl, benzenesulfonyl, p-toluenesulfonyl, and o-carboxybenzenesulfonyl).

The alkoxy group represented by $R_3$ or $R_6$ preferably is an alkoxy group having 1 to 10 carbon atoms, for example, methoxy, ethoxy, n-butoxy, n-octoxy, 2-ethyhexyloxy, isobutoxy, and isopropoxy.

The halogen atom represented by $R_3$ or $R_6$ includes chlorine, bromine and fluorine.

The ring formed by combining $R_1$ and $R_4$ or $R_2$ and $R_5$ can include, for example, a julolidine group.

The 5- or 6-membered ring formed by combining $R_1$ and $R_2$, for example, can include a piperidine group, a morpholine group, and pyrrolidine group.

The methine group represented by $L_1$, $L_2$ or $L_3$ may have a substituent (for example, methyl, ethyl, cyano, phenyl, a chlorine atom, and hydroxypropyl).

The electron attractive groups represented by X and Y may be the same or different and each preferably represents a cyano group, a carboxyl group, an alkylcarbonyl group which may be substituted (for example, acetyl, propionyl, heptanoyl, dodecanoyl, hexadecanoyl, and 1-oxo-7-chloroheptyl), an arylcarbonyl group which may be substituted (for example, benzoyl, 4-ethoxycarbonylbenzoyl, and 3-chlorobenzoyl), an alkoxycarbonyl group which may be substituted (for example, methoxycarbonyl, ethoxycarbonyl, butoxycarbonyl, t-amyloxycarbonyl, hexyloxycarbonyl, 2-ethylhexyloxycarbonyl, octyloxycarbonyl, decyloxycarbonyl, dodecyloxycarbonyl, hexadecyloxycarbonyl, octadecyloxycarbonyl, 2-butoxyethoxycarbonyl, 2-methylsulfonylethoxycarbonyl, 2-cyanoethoxycarbonyl, 2-(2-chloroethoxy)ethoxycarbonyl, and 2-[2-(2-chloroethoxy)ethoxy]ethoxycarbonyl), an aryloxycarbonyl group which may be substituted (for example, phenoxycarbonyl, 3-ethylphenoxycarbonyl, 4-ethylphenoxycarbonyl, 4-fluorophenoxycarbonyl, 4-nitrophenoxycarbonyl, 4-methoxyphenoxycarbonyl, and 2,4-di-(t-amyl)phenoxycarbonyl), a carbamoyl group which may be substituted (for example, ethylcarbamoyl, dodecylcarbamoyl, phenylcarbamoyl, 4-methoxyphenylcarbamoyl, 2-bromophenylcarbamoyl, 4-chlorophenylcarbamoyl, 4-ethoxycarbonylphenylcarbamoyl, 4-propylsulfonylphenylcarbamoyl, 4-cyanophenylcarbamoyl, 3-methylphenylcarbamoyl, 4-hexyloxyphenylcarbamoyl, 2,4-di-(t-amyl)phenylcarbamoyl, 2-chloro-3-(dodecyloxycarbamoyl)phenylcarbamoyl, and 3-(hexyloxycarbonyl)phenylcarbamoyl), a sulfonyl group (for example, methylsulfonyl and phenylsulfonyl), and a sulfamoyl group which may be substituted (for example, sulfamoyl and methylsulfamoyl).

Non-limiting examples of the dyes used in the present invention are set forth below:

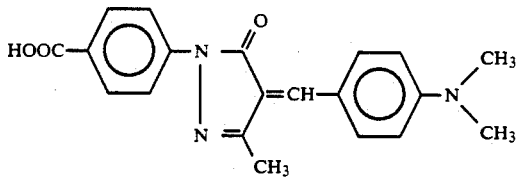

I-1

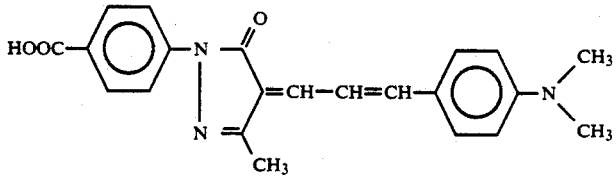

I-2

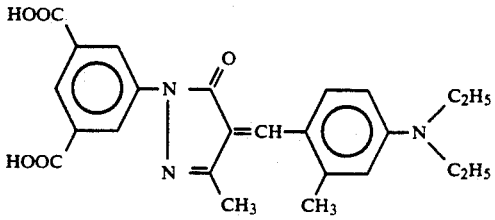

I-3

-continued
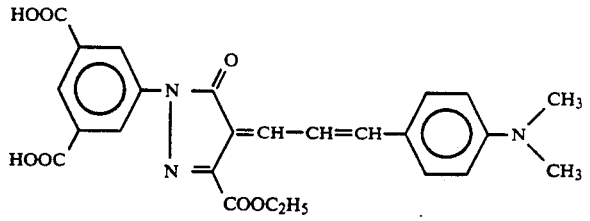
I-4
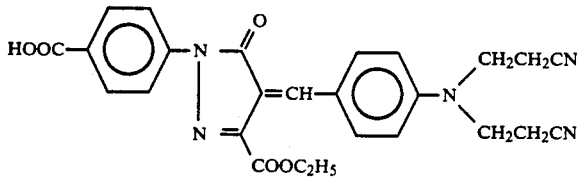
I-5
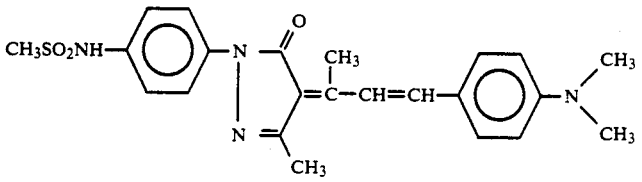
I-6
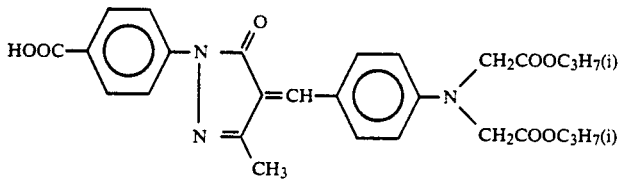
I-7
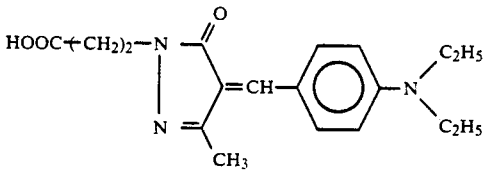
I-8
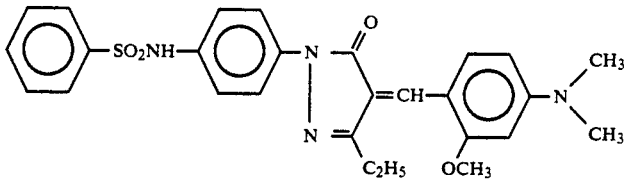
I-9
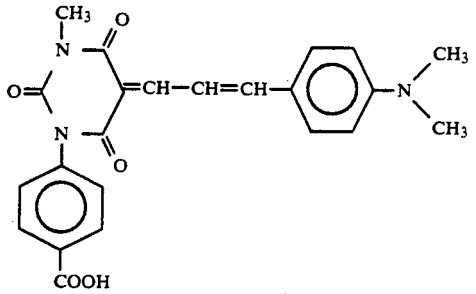
I-10

-continued
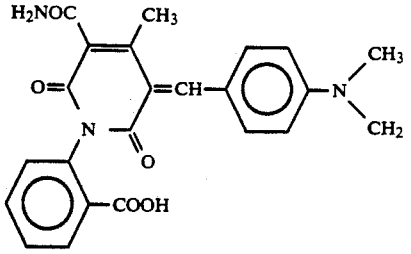
I-11
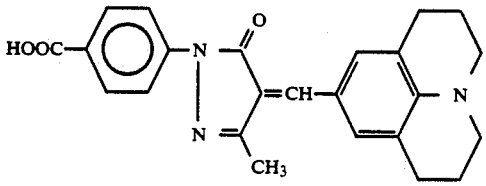
I-12
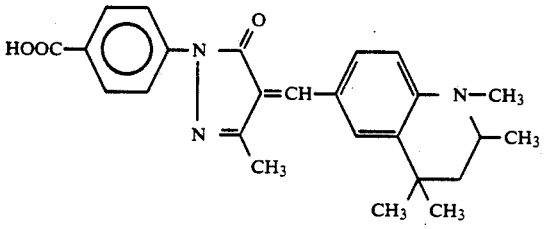
I-13
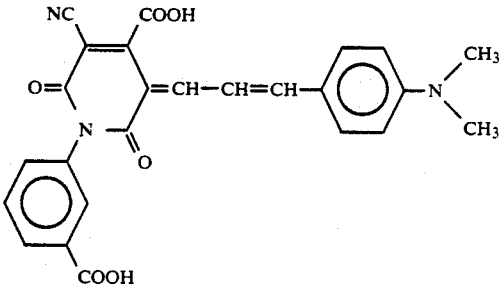
I-14
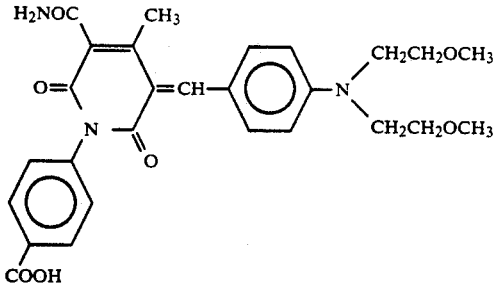
I-15
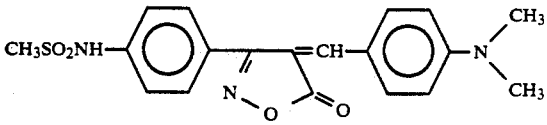
I-16
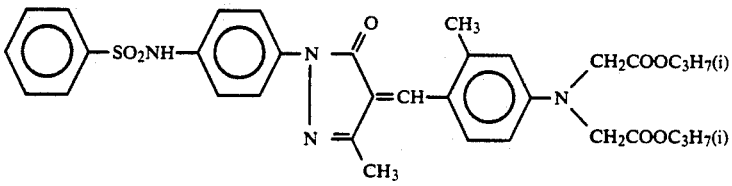
I-17

-continued
I-18
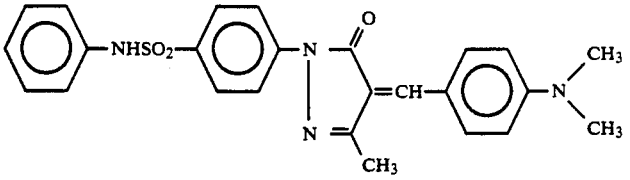
I-19
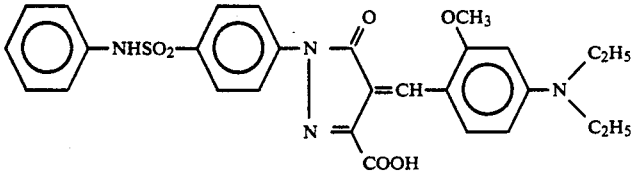
I-20
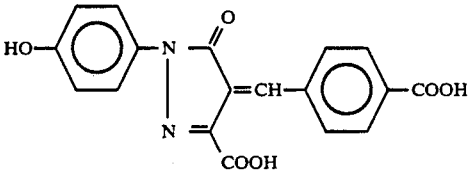
I-21
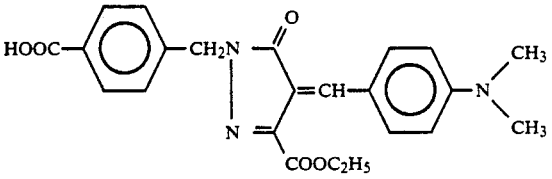
I-22
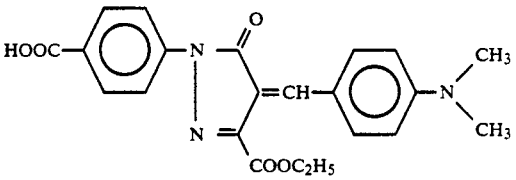
I-23
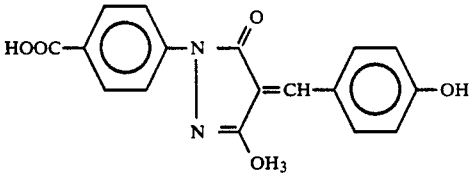
I-24
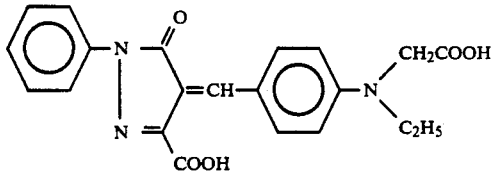
I-25
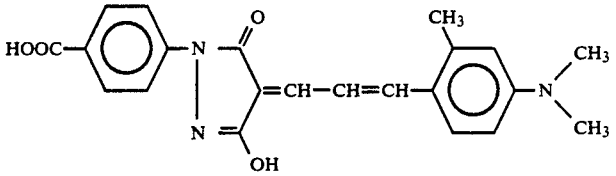

-continued
I-26
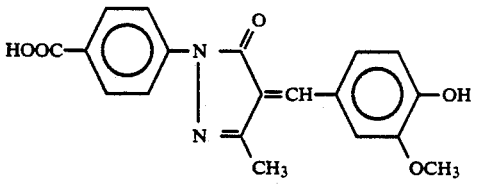
I-27
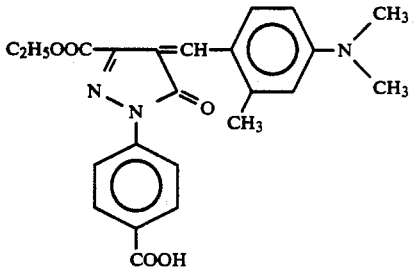
I-28
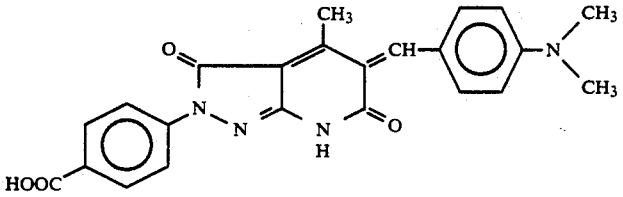
I-29
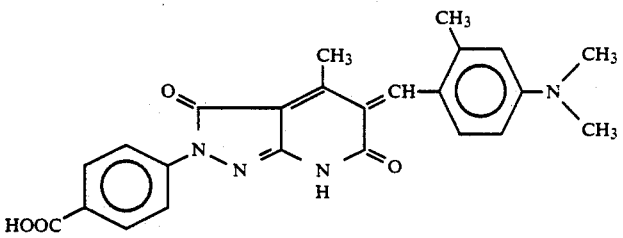
I-30
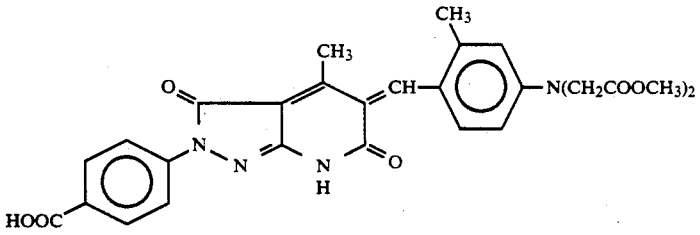
I-31
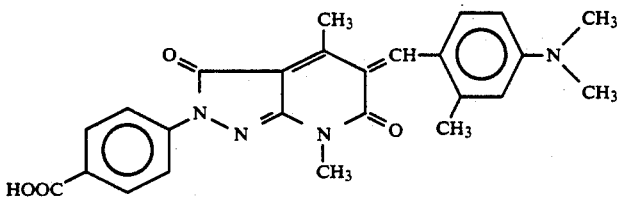
I-32
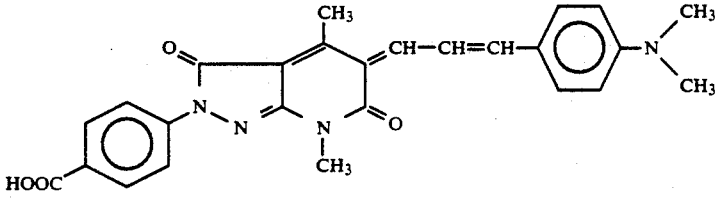

-continued
I-33
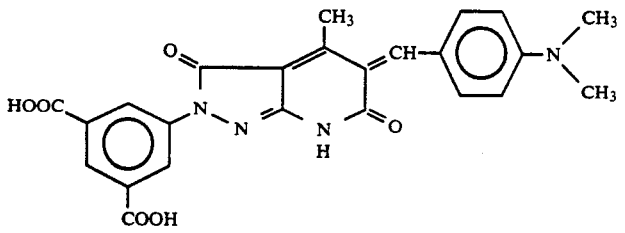
I-34
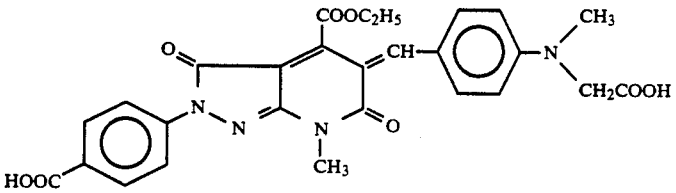
I-35
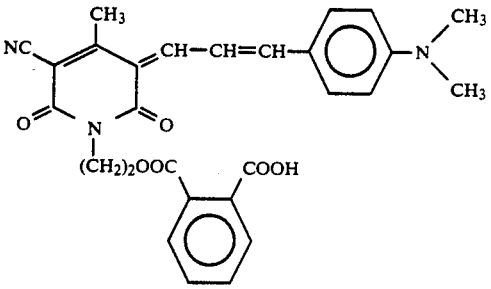
II-1
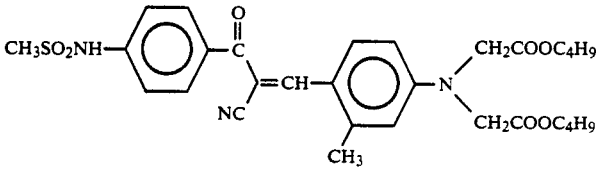
II-2
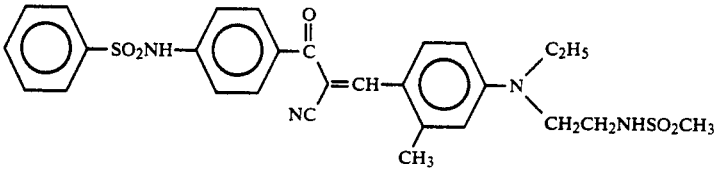
II-3
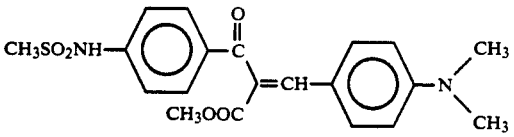
II-4
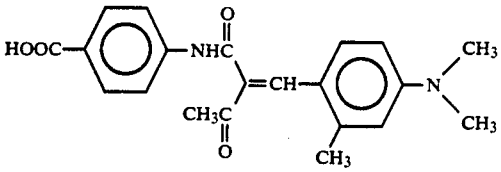
II-5
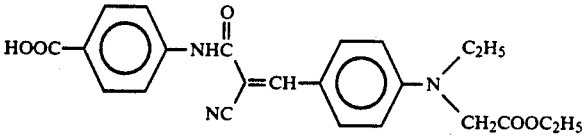

-continued
II-6
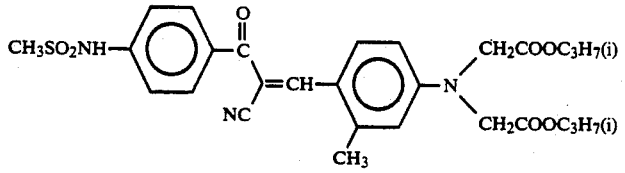
III-1
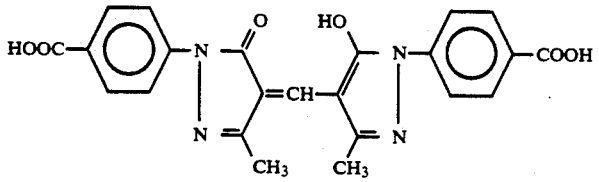
III-2
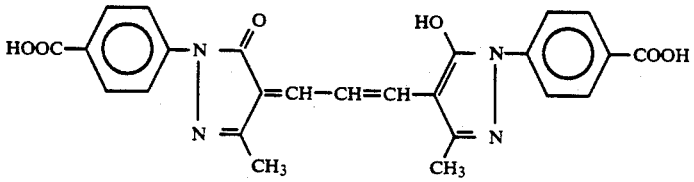
III-3
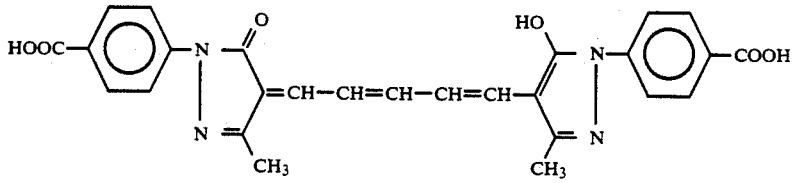
III-4
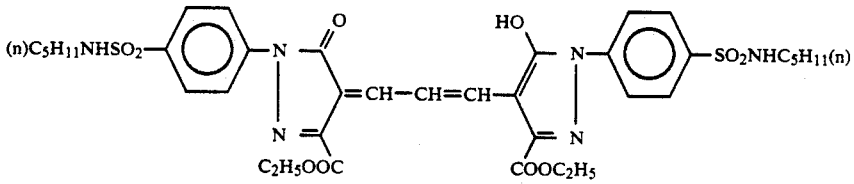
III-5
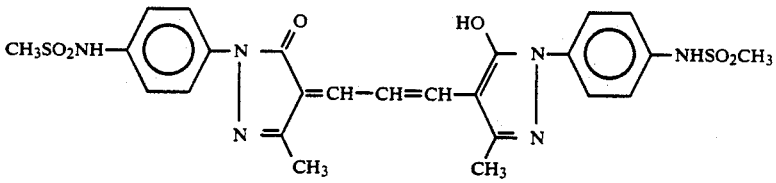
III-6
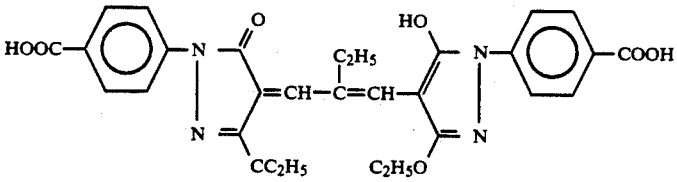
III-7
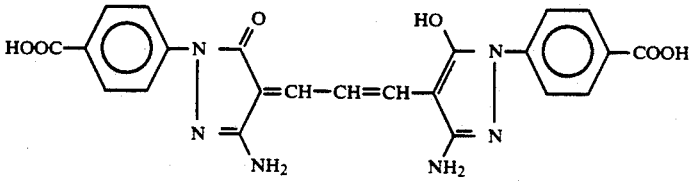

-continued
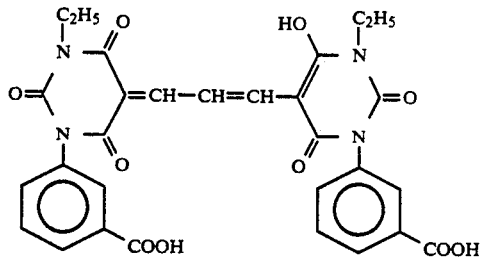
III-8
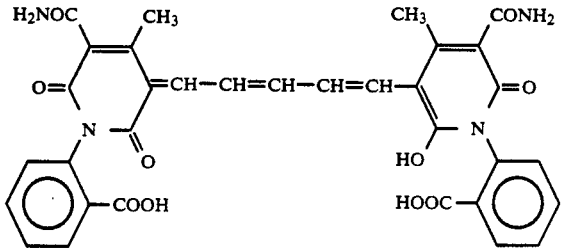
III-9
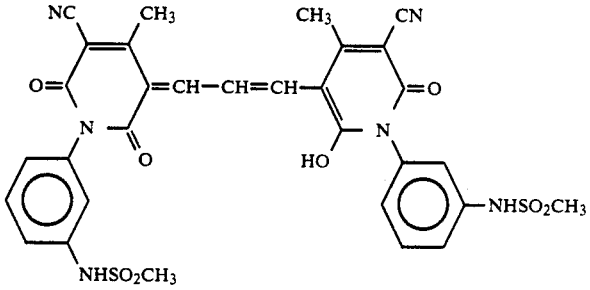
III-10
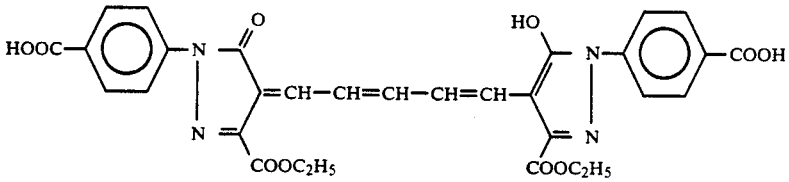
III-11
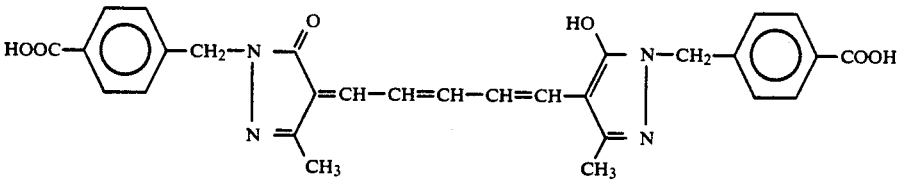
III-12
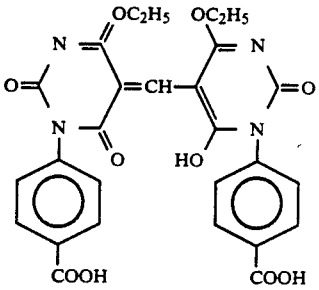
III-13

-continued
III-14
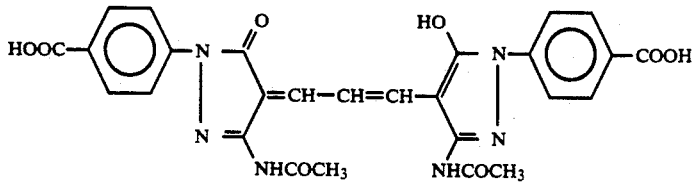
III-15
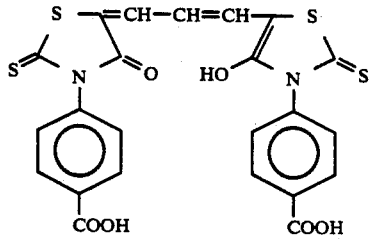
III-16
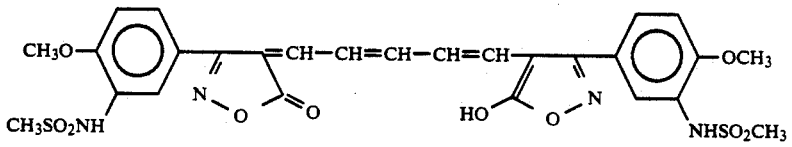
III-17
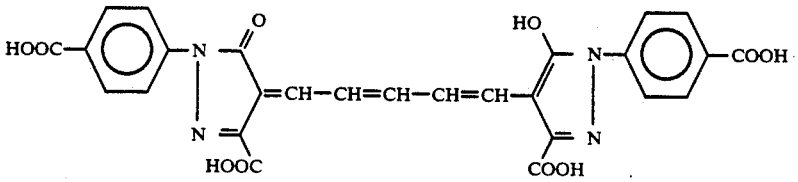
III-18
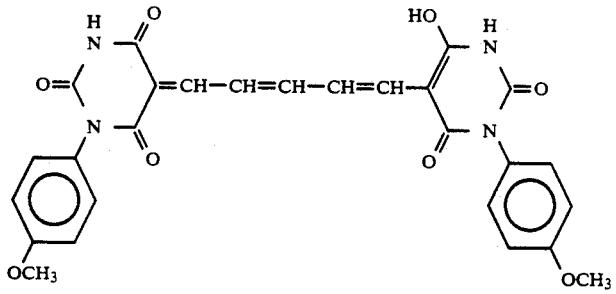
III-19
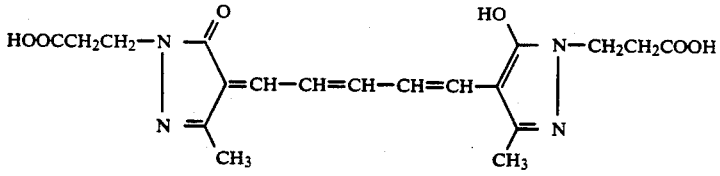
III-20
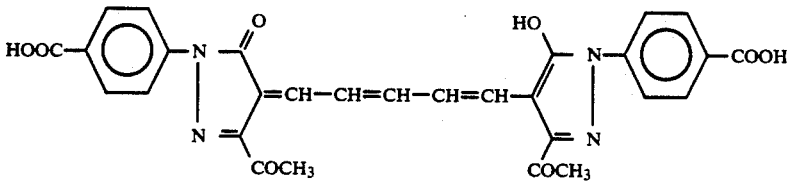
III-21
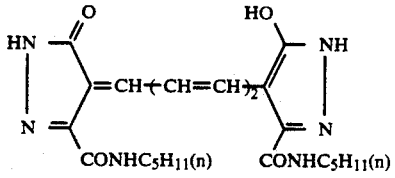

-continued
III-22
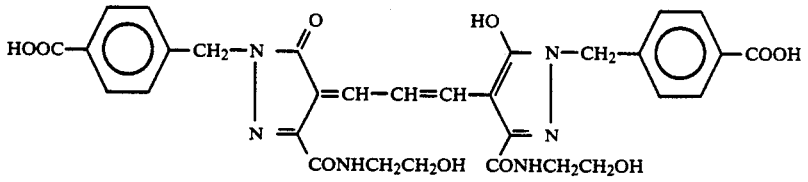
III-23
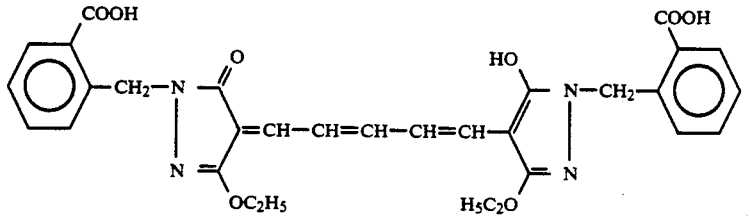
III-24
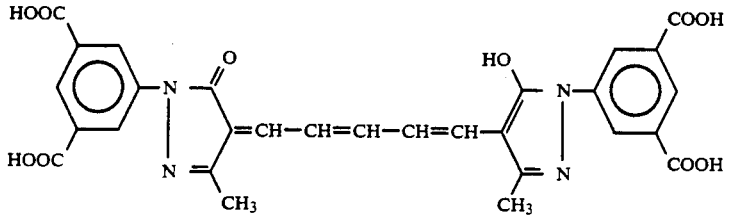
III-25
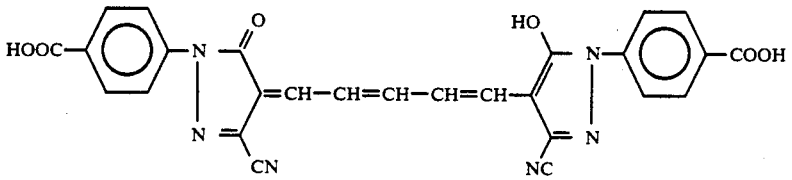
III-26
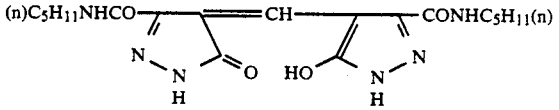
III-27
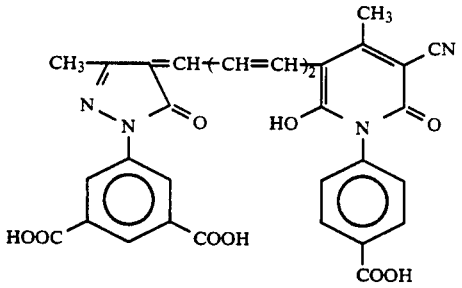
III-28
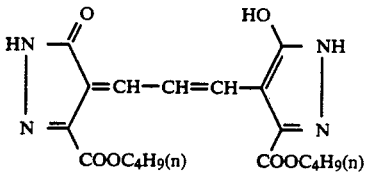
III-29
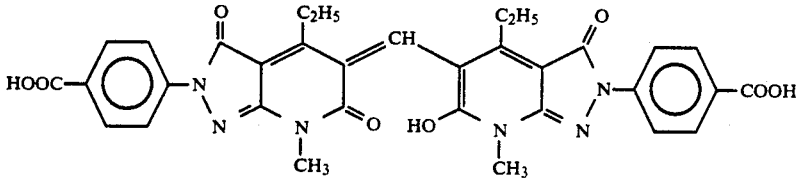

-continued
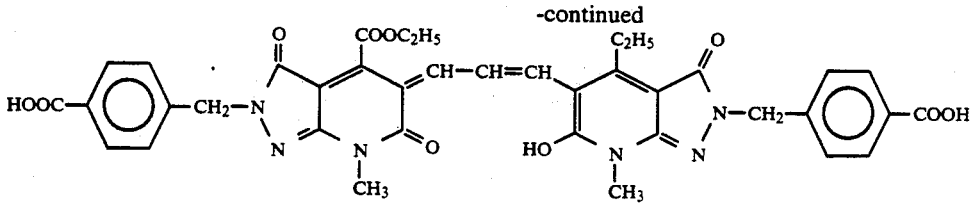
III-30
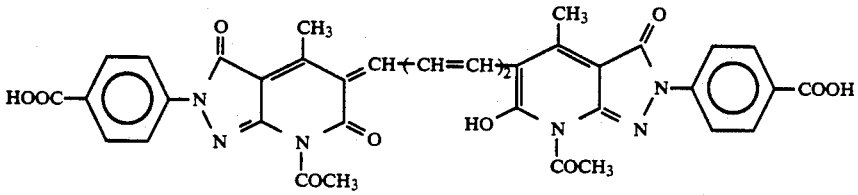
III-31
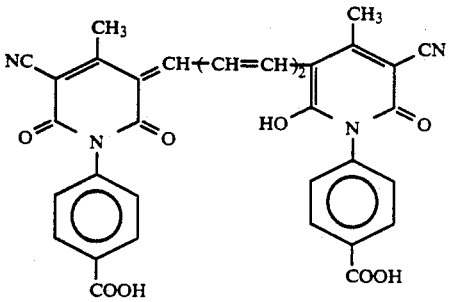
III-32
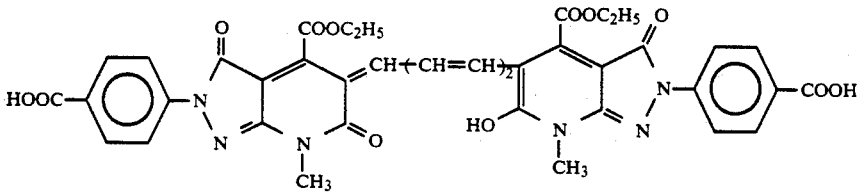
III-33
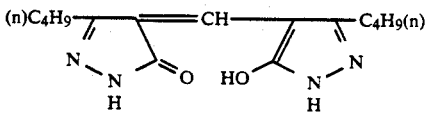
III-34
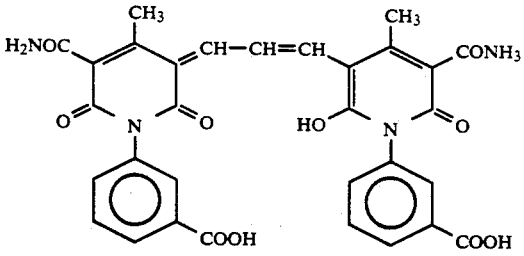
III-35
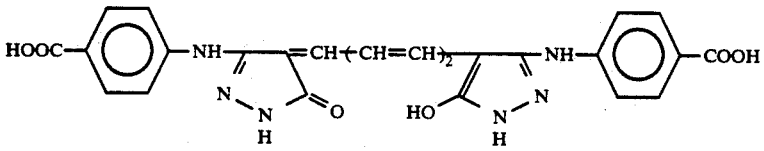
III-36
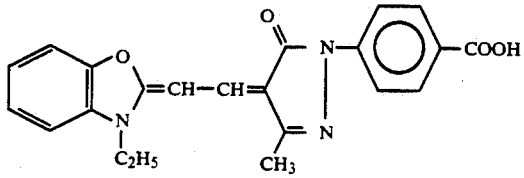
IV-1

-continued
IV-2
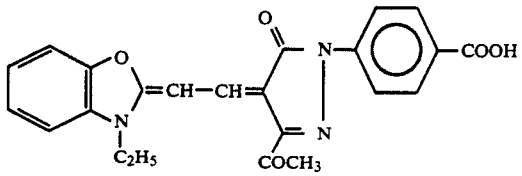
IV-3
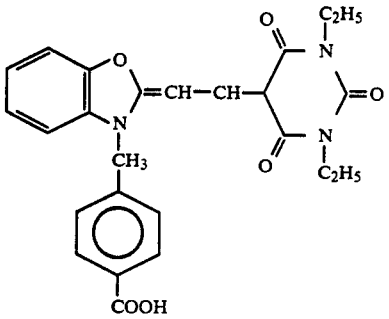
IV-4
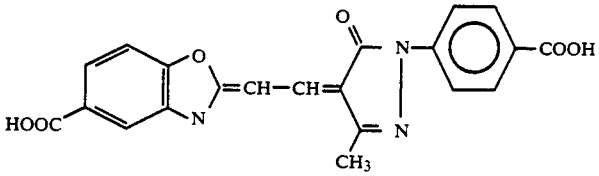
IV-5
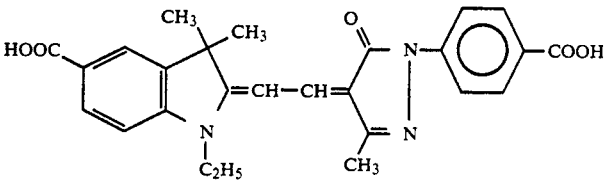
IV-6
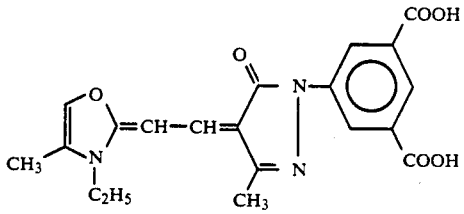
IV-7
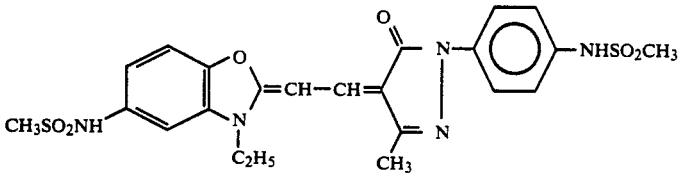
IV-8
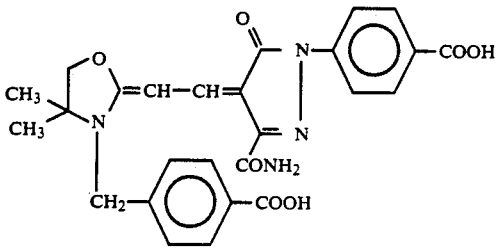

-continued
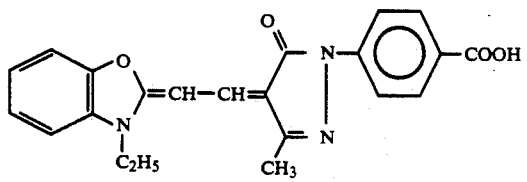
IV-9
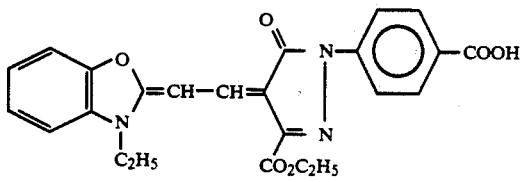
IV-10
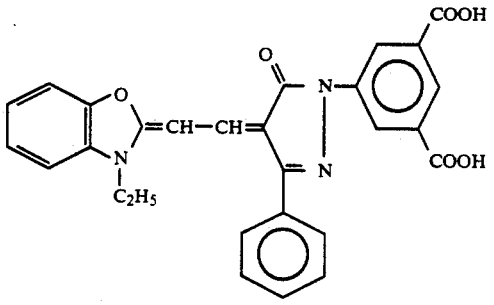
IV-11
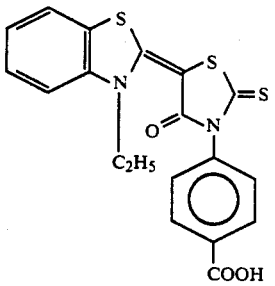
IV-12
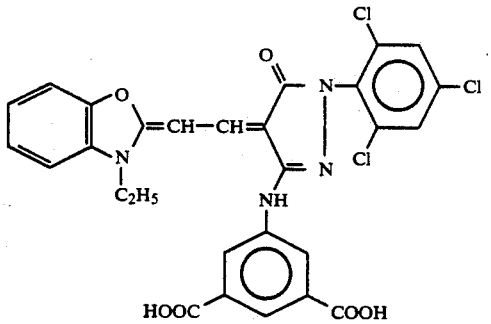
IV-13
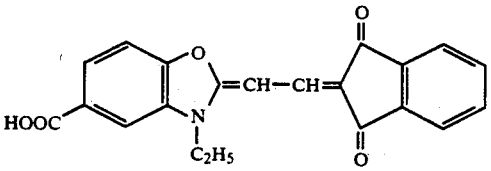
IV-14

-continued
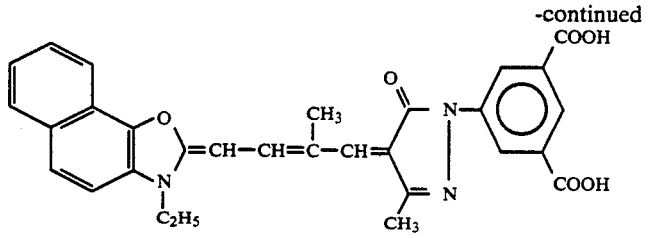
IV-15
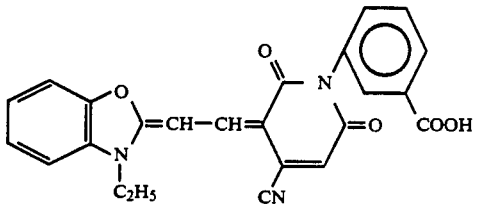
IV-16
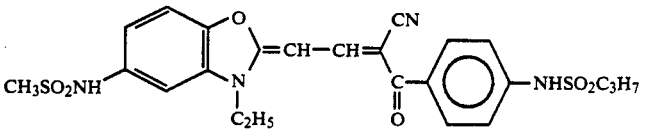
V-1
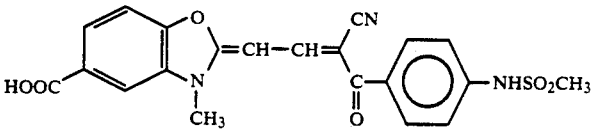
V-2
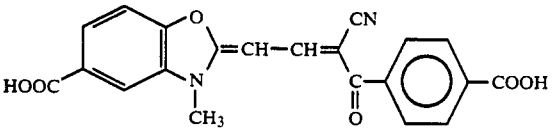
V-3
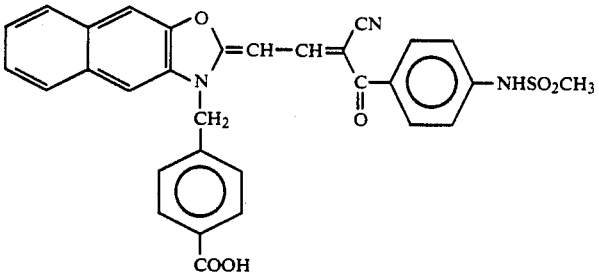
V-4
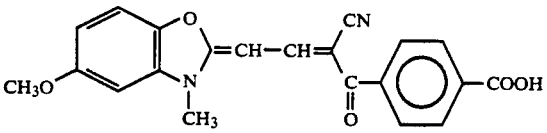
V-5
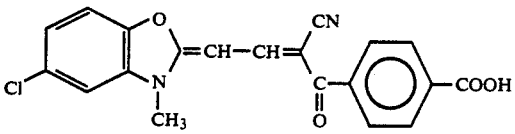
V-6
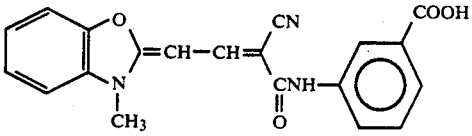
V-7

-continued
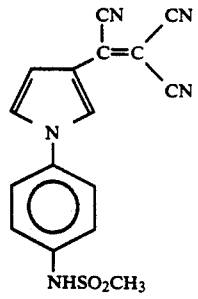
VI-1
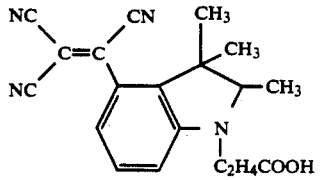
VI-2
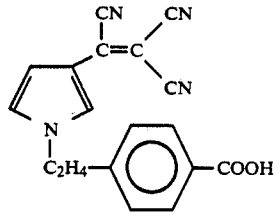
VI-3
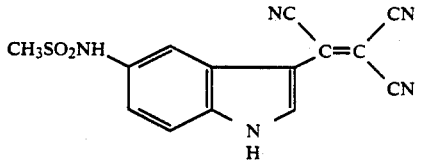
VI-4
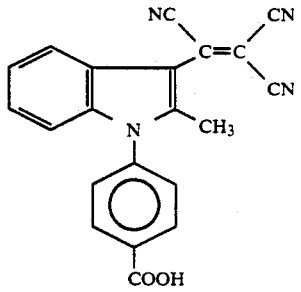
VI-5
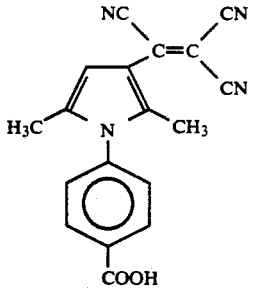
VI-6
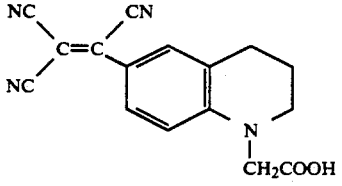
VI-7

-continued
VI-8
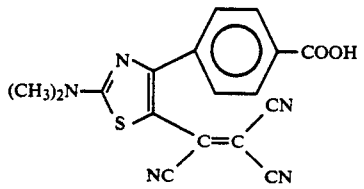
VI-9
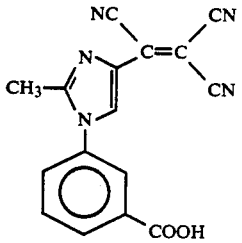
VI-10
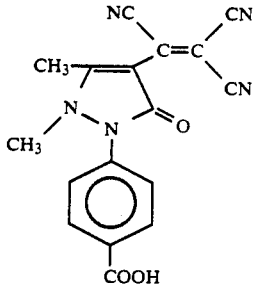
VI-11
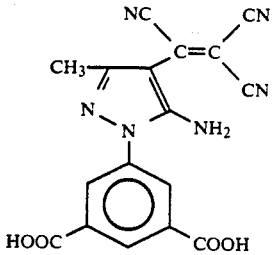
VI-12
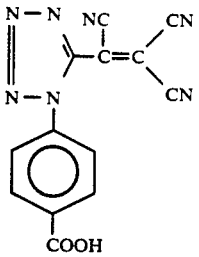
VI-13
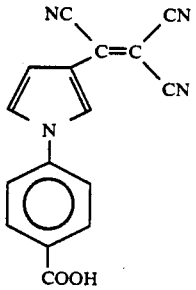

-continued
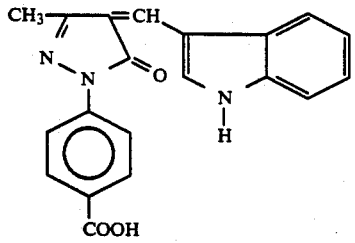
VII-1
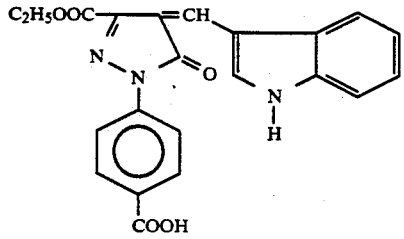
VII-2
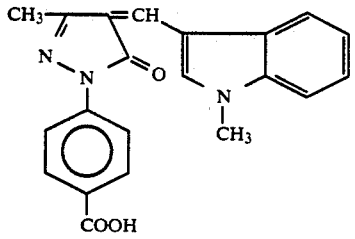
VII-3
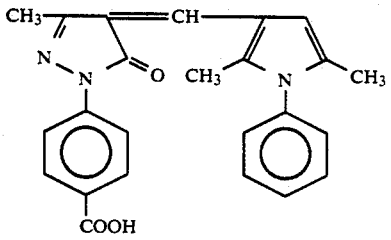
VII-4
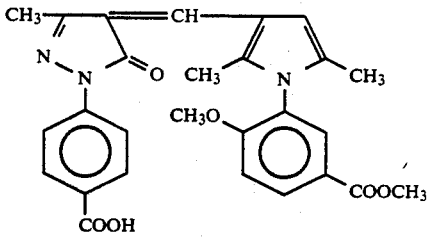
VII-5
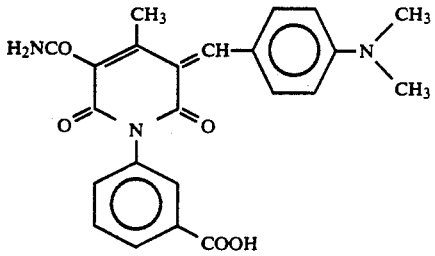
VII-6

-continued

VII-7

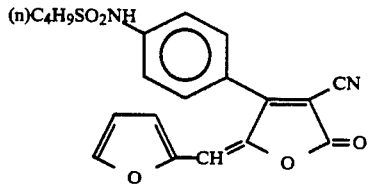

The dyes used in the present invention can be readily synthesized by or according to the methods described in W088/04794, EP-A-274723, EP-A-276566 and EP-A-299435, JP-A-52-92716, JP-A-55-155350, JP-A-55-155351, JP-A-61-205934, and JP-A-48-68623, U.S. Pat. Nos. 2,527,583, 3,486,897, 3,746,539, 3,933,798, 4,130,429, and 4,040,841, Japanese Patent Application Nos. 1-50874 and 2-303170, and Japanese Patent Application Nos. 1-103751, 1-307363, and 1-332149 (corresponding to JP-A-2-282244, JP-A-3-167546, and JP-A-3-192157, respectively).

An anionic polymer is used in the dispersant dispersing a dye in a solid form and various known polymers can be used. Preferred anionic polymers include synthetic anionic polymers such as polyacrylic acid, a copolymer of acrylic acid, polymethacrylic acid, a copolymer of methacrylic acid, a copolymer of maleic acid, a copolymer of maleic acid monoester, and a copolymer of acryloylmethylpropanesulfonic acid; semi-synthetic anionic polymers such as carboxymethyl starch and carboxymethyl cellulose; and natural polymers such as alginic acid and pectic acid. These polymers are often converted to the sodium salts to be used in a high water solubility state. The synthetic polymers can be used in the form of a block copolymer or a graft copolymer if needed.

A particularly preferred dispersant polymer is carboxymethyl cellulose, and polymers having a low molecular weight (a viscosity in a 1 weight % aqueous solution: 100 cp or lower) are preferred.

The anionic polymers used as a dispersant not only provide an excellent dispersion stability but also have less dissolving ability against a dye as compared with a known surface active agent with a low molecular weight, and accordingly, when a hydrophilic colloid layer containing a dye dispersed in solid form is coated, the dye can be fixed to an aimed layer in a higher ratio. Furthermore, when a surface active agent with a low molecular weight is used, it can reduce surface tension extremely, which sometimes deteriorates the coating property, and it diffuses and is transferred in hydrophilic layers, which can negatively affect the photographic performances.

Where an anionic polymer is used as a dispersant for a dye dispersed in solid form, the amount used is preferably 1 to 100% by weight, particularly preferably 2 to 30% by weight based on the amount of the dye.

Particularly preferred combinations of a dye and a dispersant are the dye of Formula (I) and carboxymethyl cellulose, the dye of Formula (III) and carboxymethyl cellulose, and compound III-3 and carboxymethyl cellulose.

Methods for dispersing a dye in solid form with an anionic polymer in the present invention (that is, a method for preparing a dispersed solid form of the dye) include a method in which a dispersed solid form of the dye is mechanically formed in water in the presence of a dispersant with a ball mill, a sand mill or a colloid mill. It is also possible to obtain the dispersed solid form of the dye by a method in which the dye is dissolved in an alkaline solution by adjusting the pH to a value in which the dye can be dissolved and then lowering the pH value in the presence of an anionic polymer to obtain the dispersed solid form of the dye as a fine solid deposition, and further by a method in which the dye is dissolved in an appropriate solvent, e.g., dimethylformamide, and then a poor solvent, e.g., water for the dye is added thereto in the presence of an anionic polymer to obtain the dispersed solid form of the dye.

The dispersed solid form of a dye according to the present invention can be added to a layer in a necessary amount according to the purpose for which it is used and is preferably used in a range of optical density of about 0.05 to about 3.0. The amount of dye differs according to the dye used. A preferable amount can be generally found in the range of about $1\times10^{-3}$ to about 3.0 g/m$^2$, particularly $1\times10^{-3}$ to 1.0 gm/m$^2$.

Also, the dispersed solid form of the dye of the present invention can be incorporated into an arbitrary layer of a light-sensitive material according to the purpose sought. That is, it can be incorporated into hydrophilic colloid of a subbing layer, an anti-halation layer provided between a silver halide emulsion layer and a support, a silver halide emulsion layer, an intermediate layer, a protective layer, a back layer provided on a support on the side opposite from a silver halide emulsion layer, and other auxiliary layers.

The dispersed solid form of the dye of the present invention may be added not only to a single layer but to plural layers according to necessity, and plural dyes may be used independently or in combination in a single layer or plural layers.

The dispersed solid form of the dye of the present invention can be used in combination with other various water-soluble dyes, a water-soluble dye adsorbed to a mordant, an emulsified and dispersed dye, or a dispersed solid form of a dye prepared by a method different from that of the present invention, according to necessity.

Examples of the combination include a case where the dispersed solid form of the dye of the present invention is added to an anti-halation layer, and the water-soluble dye is added to a silver halide emulsion layer for the purpose of preventing irradiation; and a case where the dispersed solid form of the dye of the present invention is added to an anti-halation layer, and the dispersed solid form of the dye prepared by a method different from that of the present invention or the emulsified and dispersed dye is added to a protective layer in order to achieve sensitivity adjustment, or improvement in safety of safelight.

Hydrophilic colloid is most preferably gelatin, and known gelatin can be used. For example, gelatin manufactured by different methods can be used, such as lime-treated gelatin and acid-treated gelatin, and gelatin prepared by subjecting these gelatins thus obtained to a chemical modification of phthalization or sulfonylization. Further, gelatin subjected to a desalination treatment can also be used. The mixing ratio of dye and gelatin is different according to kind, dispersing degree, and necessary absorbance of dye and usable amount of gelatin, and it is preferably in the of $1/10^3$ to $\frac{1}{3}$.

The dye of the present invention dispersed in solid form is subjected to development processing to be decomposed primarily by hydroquinone, sulfite or alkali contained in the developing solution and eluted, and, therefore, it does not cause coloring and stain on the photographic image. The time necessary for decoloring markedly depends on the concentration of hydroquinone contained in the developing solution and the other processing solutions; the amount of nucleophilic reagent of sulfite, alkali or others; the kind, amount and adding position of the compounds of the present invention; amount and swelling degree of hydrophilic colloid; and degree of stirring. Therefore, it can not be entirely regulated. However, it can be arbitrarily controlled according to a general regulation of physicochemistry.

The pH value of a processing solution is different for developing, bleaching and fixing, and it is usually in the range of pH 3.0 to 13.0, preferably 5.0 to 12.5. Accordingly, the compounds of the present invention are characterized by the fact that they can release a dye unit by processing in such a relatively low pH processing solution.

In a photographic light-sensitive material having a light-sensitive silver halide emulsion layer used in the present invention, a light-sensitive material usually used in this field is used, and a silver halide emulsion used in this field is applied as well. For example, a light-sensitive material and a silver halide emulsion as described in JP-A-3-13936 and JP-A-3-13937 can be used. Specifically, a silver halide photographic emulsion, a light-sensitive material containing the emulsion, a support, and processing method and exposing method can be used as described on the 8th line of the right lower column at page 8 to the 9th line of the left upper column at page 15 of JP-A-3-13936.

The present invention will be explained with reference to the Examples but should not be construed as limited thereto.

EXAMPLE 1

A pre-mixed composition was prepared according to the following dispersing procedure and then dispersed with a sand grinder for 3 hours, whereby a dispersed solid form of a dye was prepared.

| Dispersing procedure: | |
|---|---|
| Dye powder | 20 g |
| Dispersant | 5 to 20% by weight based on an amount of the dye |
| Water | was added up to 500 g |

The results according to the kind of dye and kind and amount of dispersant are shown in Table 1.

A dispersion solution was diluted with water to a dye concentration of 15 mg/liter and was left standing for one day. Then, it was visually observed whether a precipitation existed to determine the stability of the dispersant.

Triton X-200 (shown as A in Table 1) which was tested in W088/04794 was used as a comparative dispersant. Carboxymethyl cellulose sodium salt (Celogen 6A manufactured by Daiichi Kogyo Seiyaku Co., Ltd.) was used (shown as B in Table 1) as an anionic polymer. The dye used is as listed in Table 1.

TABLE 1

| Sample No. | Dye | Dispersant Kind | Dispersant Amount | Average Particle Size (μ) | Settling |
|---|---|---|---|---|---|
| 1-1 (comp.) | I-1 | A | 18% | 0.44 | a little |
| 1-2 (inv.) | I-1 | B | 5% | 0.39 | none |
| 1-3 (comp.) | III-3 | A | 18% | 0.31 | much |
| 1-4 (inv.) | III-3 | B | 5% | 0.19 | none |
| 1-5 (inv.) | III-3 | B | 10% | 0.16 | none |

As is apparent from the results shown in Table 1, the dispersing method of the present invention can provide a dispersion containing a less used amount of a dispersant and having a fine particle size and an excellent stability.

EXAMPLE 2

Emulsion A

An aqueous silver nitrate solution (2.9M) and an aqueous halide solution containing sodium chloride (3.0M) and ammonium hexachlororhodium (III) acid ($5.3\times10^{-5}$M) were added, while stirring, to an aqueous gelatin solution having a pH of 2.0 containing sodium chloride (0.05M) at 38° C. for 4 minutes at a rate of 40 cc/min. at a constant potential of 100 mV for the formation of nuclei. One minute later, an aqueous silver nitrate solution (2.9M) and an aqueous halide solution containing sodium chloride (3.0M) were added at half of the speed of the nucleus formation at 38° C. for 8 minutes at a constant potential of 100 mV. Thereafter, the emulsion was subjected to a washing treatment according to a conventional flocculation method. Then, gelatin was added and the pH and pAg were adjusted to 5.7 and 7.4, respectively. Further, 5,6-trimethylene-7-hydroxy-s-triazolo(2,3-a)pyrimidine in an amount of 0.05 mole per mole of silver was added as a stabilizer. The grains thus obtained were silver chloride cubic grains containing Rh of $8.0\times10^{-6}$ mole per mole of silver and having an average grain size of 0.13 μm (a variation coefficient: 11%).

Emulsion B

An aqueous silver nitrate solution (2.9M) and an aqueous halide solution containing sodium chloride (2.6M), potassium bromide (0.4M) and ammonium hexachlororhodium (III) acid ($5.3\times10^{-5}$M) were added, while stirring, to an aqueous gelatin solution having a pH of 2.0 containing sodium chloride (0.05M) at 40° C. for 4 minutes at a rate of 40 cc/min. at a constant potential of 85 mV for the formation of nuclei. One minute later, an aqueous silver nitrate solution (2.9M) and an aqueous halide solution containing sodium chloride (2.6M) and potassium bromide (0.4M) were added at the half of the speed of the nucleus formation at 40° C. for 8 minutes at a constant potential of 85 mV. Thereafter, the emulsion was subjected to a washing treatment according to a conventional flocculation method. Then, gelatin was added and pH and pAg were adjusted to 5.7 and 7.4, respectively. Further, 6-methyl-4-hydroxy-1,3,3a,7-tetrazaindene in an amount of $3.0\times10^{-3}$ mole per mole of silver was added as a stabilizer. The grains thus obtained were silver bromochloride cubic grains containing Rh of $8.0\times10^{-6}$ mole per mole of silver and having an average grain size of 0.16 μm (a Br content: 15%, a variation coefficient: 12%).

1-phenyl-5-mercaptotetrazole in an amount of 2.5 mg/m² and a polyethyl acrylate latex (an average particle size: 0.05 μm) in an amount of 770 mg/m² were added to emulsions A and B and, further, 2-bis(vinylsulfonylacetamido)ethane in an amount of 126 mg/m² was added as a hardener. The emulsions thus prepared were coated, respectively, on a polyester support so that the coated amounts of silver and gelatin became 3.6 g/m² and 1.5 g/m², respectively.

A lower protective layer was coated thereon containing gelatin in an amount of 0.8 g/m², lipo acid in an amount of 8 mg/m², and a polyethyl acrylate latex (an average particle size: 0.05 μm) in an amount of 230 mg/m². Further, an upper protective layer was coated thereon containing gelatin in an amount of 3.2 g/m² and the dispersed solid form of the dye of the present invention as shown in Table 1 or a comparative dye, wherein a matting agent (silicon dioxide, an average particle size: 3.5 μm) in an amount of 55 mg/m², methanol silica (an average particle size: 0.02 μm) in an amount of 135 mg/m², sodium dodecylbenzenesulfonate in an amount of 25 mg/m² as a coating aid, sulfuric acid ester sodium salt of polyoxyethylene nonylphenyl ether in an amount of 20 mg/m² (polymerization degree: 5), and a potassium salt of N-perfluorooctanesulfonyl-N-propylglycine in an amount of 3 mg/m² were simultaneously coated to prepare the samples.

The support used in this example have a back layer and back protective layer with the following compositions (a swelling rate in a back side: 110%):

| | |
|---|---|
| Composition of a back layer | |
| Gelatin | 170 mg/m² |
| Sodium dodecylbenzenesulfonate | 32 mg/m² |
| Sodium dihexyl-α-sulfosuccinate | 35 mg/m² |
| $SnO_2$/Sb (9/1 ratio by weight, an average particle size: 0.25 μm) | 318 mg/m² |
| Composition of a back protective layer | |
| Gelatin | 2.7 g/m² |
| Silicon dioxide matting agent (an average particle size: 3.5 μm) | 26 mg/m² |
| Sodium dihexyl-α-sulfosuccinate | 20 mg/m² |
| Sodium dodecylbenzenesulfonate | 67 mg/m² |
| $C_8F_{17}SO_2N(C_3H_7)$—$(CH_2CH_2O)_n$—$(CH_2)_4$—$SO_3Li$ | 5 mg/m² |
| Dye A | 190 mg/m² |
| Dye B | 32 mg/m² |
| Dye C | 59 mg/m² |
| Polyethyl acrylate latex (an average particle size: 0.05 μm) | 260 mg/m² |
| 1,3-Divinylsulfonyl-2-propanol | 149 mg/m² |

The above dyes A B and C are shown below:

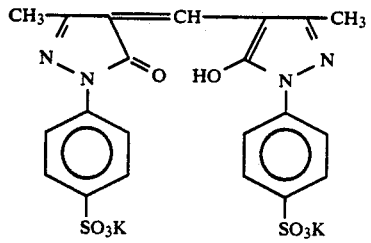

Dye A

-continued

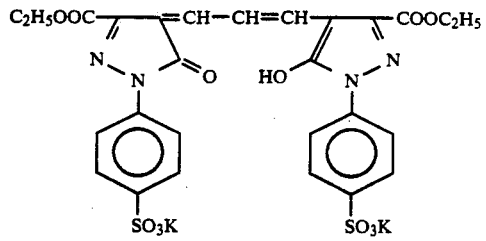

Dye B

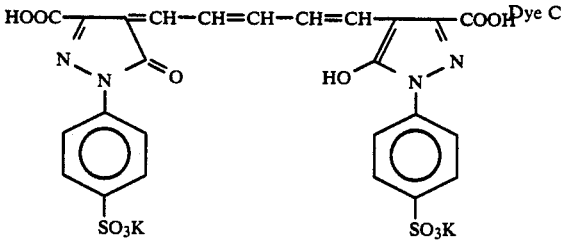

Dye C

Photographic properties

The samples thus obtained were exposed via an optical wedge with a P-617DQ printer (quartz) manufactured by Dainippon Screen Co., Ltd. and were subjected to a development processing at 38° C. for 20 seconds in the developing solution LD-835 manufactured by Fuji Photo Film Co., Ltd., followed by fixing, washing and drying (an automatic developing machine FG-800RA). These samples were evaluated for the following properties:

1) Relative sensitivity: defined by a reciprocal of an exposure providing a density of 1.5 and expressed by a value relative to that of Sample 1, which is set at 100.

2) γ: (3.0–0.3)/-[log (exposure giving a density of 3.0) log(exposure giving a density of 0.3)].

Also, superimposed letter image quality was evaluated, wherein a light-sensitive material, an original and a supporting base were superposed in the following order and exposed through the original:

(a) a transparent or translucent supporting base,
(b) a line original,
(c) a transparent or translucent supporting base,
(d) a dot original, and
(e) a contact type light-sensitive material.

The superimposed letter image quality 5, which shows a very good quality, means the quality in which a letter of a 30 μm width is reproduced when a halftone dot area of 50% is reasonably exposed on a contact type light-sensitive material so that a halftone dot area of 50% is formed thereon. On the other hand, the superimposed letter image quality 1, which shows bad quality, means the quality in which only a letter of a 150 μm width or more can be reproduced. The grades of 4 to 2 have been provided between 5 and 1. The grade of 3 or higher is a practicable level.

Any of the processed samples has no residual color, and as is apparent from the results shown in Table 2, an excellent superimposed letter image quality can be obtained without the deterioration of a sensitivity and a gradation, and the performance in a contact exposure process has been secured.

The following water-soluble dye D was used as a comparative dye.

Comparative Dye D

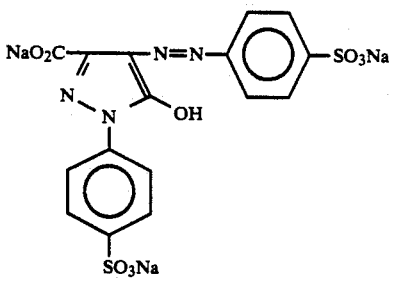

The results are shown in Table 2.

TABLE 2

| Sample No. | Emulsion | Dye Kind | Dye Added amount | Relative Sensitivity | γ | Superimposed Letter Image Quality |
|---|---|---|---|---|---|---|
| 2-1 (Comp.) | A | D | 10 mg/m² | 100 | 7.5 | 1.5 |
| 2-2 (Inv.) | A | Sample 1-2 | 40 | 99 | 8.0 | 3.5 |
| 2-3 (Comp.) | B | D | 15 | 100 | 5.5 | 1.5 |
| 2-4 (Inv.) | B | Sample 1-2 | 60 | 99 | 5.9 | 3.5 |

EXAMPLE 3

Support

The following coating solutions were applied on a biaxially oriented polyethylene terephthalate film of 100 μm subjected to a corona discharge treatment with a wire bar coater so that the coated amounts are as shown below, followed by drying at 170° C. for one minute.

First subbing layer

| | |
|---|---|
| Butadiene-styrene copolymer latex (Butadiene/styrene weight ratio: 31/69) | 0.16 g/m² |
| Sodium 2,4-dichloro-6-hydroxy-s-triazine | 4.2 g/m² |

Second subbing layer:

The second subbing layer was applied on the above first subbing layer so that the coated amount is as shown below, followed by drying at 175° C. for one minute.

| | |
|---|---|
| Gelatin | 0.08 g/m² |
| $C_{12}H_{25}O(CH_2CH_2O)_{10}H$ | 7.5 mg/m² |

Preparation of an emulsion

A surface latent image type emulsion was prepared according to the following method.

| | |
|---|---|
| **Solution I 75° C.** | |
| Inert gelatin | 24 g |
| Distilled water | 900 ml |
| KBr | 4 g |
| Phosphoric acid (10% aqueous solution) | 2 ml |
| Sodium benzenesulfinate | $5 \times 10^{-2}$ mol |
| 2-Mercapto-3,4-methylthiazole | $2.5 \times 10^{-3}$ g |
| **Solution II 35° C.** | |
| Silver nitrate | 170 g |
| Distilled water to make | 1000 ml |

-continued

| | |
|---|---|
| **Solution III 35° C.** | |
| KBr | 230 g |
| Distilled water to make | 1000 ml |
| **Solution IV room temperature** | |
| Potassium hexacyano ferrate (II) | 3.0 g |
| Distilled water to make | 100 ml |

Solutions II and III were simultaneously added while stirring to Solution I over a period of 45 minutes, and at the time when addition of all of Solution II was finished, a monodisperse cubic emulsion having an average particle size of 0.28 μm was finally obtained.

In this preparation, Solution III was added adjusting the addition speed against that of Solution II so that the pAg value in a mixing vessel was always maintained at 7.50. Solution IV was added seven minutes after the addition of Solution II started over a period of five minutes. After the addition of Solution II was finished, the emulsion was washed and desalted in succession by a sedimentation method, and then it was dispersed in an aqueous solution containing 100 g of inert gelatin. Sodium thiosulfate and chloroauric acid tetrahydrate, each in an amount of 34 mg per mole of silver, were added to this emulsion and the pH and pAg values were adjusted to 8.9 and 7.0 (40° C.), respectively, followed by subjecting the emulsion to a chemical sensitization treatment at 75° C. for 60 minutes, whereby a surface latent image type emulsion was obtained.

An anti-halation (AH) layer AH-1, the emulsion layer and a protective layer for comparison were coated, in order, on the above support to thereby prepare Comparative Sample 3-1.

| | |
|---|---|
| **AH-1:** | |
| Gelatin | 1.7 g/m² |
| Polymer mordant (shown below) | 167.8 mg/m² |
| Dye E (shown below) | 72.4 mg/m² |
| Dye F (shown below) | 68.5 mg/m² |
| Dye G (shown below) | 68.5 mg/m² |

Polymer Mordant

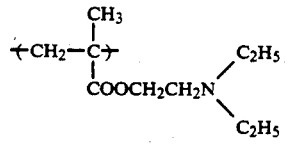

(Viscosity of a 15% aqueous solution at 30° C.: 40 cp)

Dye E

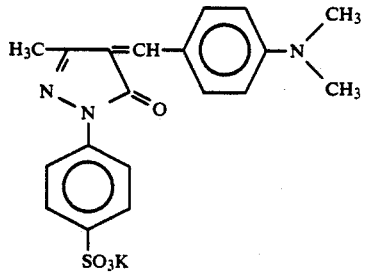

Dye F

-continued

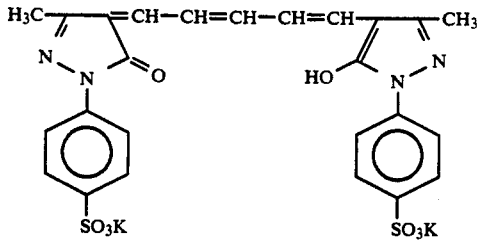

Dye G

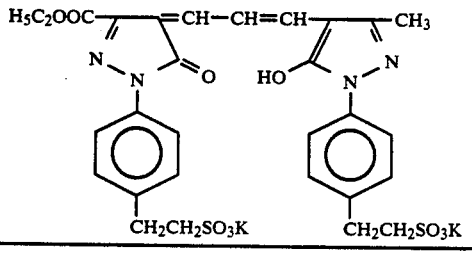

| Emulsion layer: | |
|---|---|
| Silver halide emulsion (as silver) | 1700 mg/m$^2$ |
| Sensitizing dye H shown below | 238 mg/m$^2$ |
| 5-Methylbenzotriazole | 4.1 mg/m$^2$ |
| Sodium dodecylbenzenesulfonate | 5 mg/m$^2$ |
| 1,3-Divinylsulfonyl-2-propanol | 56 mg/m$^2$ |
| Sodium polystyrenesulfonate | 35 mg/m$^2$ |

Dye H

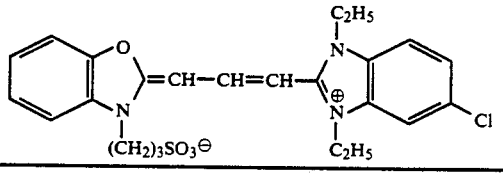

| Protective layer: | |
|---|---|
| Inert gelatin | 1300 mg/m$^2$ |
| Colloidal silica | 249 mg/m$^2$ |
| Liquid paraffin | 60 mg/m$^2$ |
| Barium strontium sulfate (average particle size: 1.5 μm) | 32 mg/m$^2$ |
| Proxel | 4.3 mg/m$^2$ |
| Potassium N-perfluorooctanesulfonyl-N-propylglycine | 5.0 mg/m$^2$ |
| 1,3-Divinylsulfonyl-2-propanol | 56 mg/m$^2$ |
| Compound Z shown below | 15 mg/m$^2$ |

Compound Z

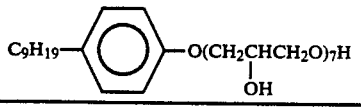

Further, AH-2 and AH-3 in which a dispersed solid form of a dye was used for an anti-halation layer (AH) were coated on the above support instead of AH-1, whereby Comparative Sample 3-2 and Sample 3-3 were prepared from AH-2 and AH-3, respectively.

| AH-2: | |
|---|---|
| Gelatin | 1.7 g/m$^2$ |
| Dispersed solid form of a dye, Sample 1-3 of Example 1, as the ingredient of the dye | 120 mg/m$^2$ |

-continued

| AH-3: | |
|---|---|
| Gelatin | 1.7 g/m$^2$ |
| Dispersed solid form of a dye, Sample 1-5 of Example 1, as the ingredient of the dye | 120 mg/m$^2$ |
| Sodium dodecylbenzenesulfonate | 15 mg/m$^2$ |

The respective unexposed samples were subjected to development processing with a deep tank automatic processing machine F-10 manufactured by Allen Products U.S.A. Co., Ltd. using a commercially available general purpose processing solution for microfilm (a developing solution FR-537 manufactured by FR Chemicals U.S.A. Co., Ltd.) in the following conditions:

| Step | Processing solution | Temperature | Time |
|---|---|---|---|
| 1. Developing | FR-537 (1:3) | 43° C. | 15 sec |
| 2. Washing | Flowing water | 43° C. | 15 sec |
| 3. Fixing | FR-535 (1:3) | 43° C. | 15 sec |
| 4. Washing | Spraying | 43° C. | 15 sec |
| 5. Drying | Hot air | — | — |

In Comparative Sample 3-2 and Sample 3-3 of the present invention, the dyes were clearly removed without leaving a residual color but in Comparative Sample 3-1, the dye remained a little bit.

Further, the respective samples each superposed by five sheets were exposed to 70 lux with a 20 W tungsten electric bulb for one minute under the condition under which the superposed samples were pressed down so as to prevent the entrance of the light from hem thereof, and then subjected to development processing under the conditions set forth above. The fog density of the fifth sheet was measured to evaluate light shielding capability. The results are shown in Table 3.

TABLE 3

| Sample No. | Fog density of 5th sheet |
|---|---|
| 3-1 (Comp.) | 2.05 |
| 3-2 (Comp.) | 0.56 |
| 3-3 (Inv.) | 0.30 |

It is revealed by the results shown in Table 3 that the dispersed solid form of a dye of the present invention has an excellent decoloring property and further an increased light shielding capability due to a raised absorbance attributable to the improvement in a dispersing property of the dye, which results in the improvement in a daylight loading property.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one light-sensitive silver halide emulsion layer, wherein a dispersed solid form of a dye is present in at least one hydrophilic colloid layer which can be either the at least one light-sensitive silver halide emulsion layer or another layer, wherein the dye is dispersed in fine particles with a solubilized anionic polymer to thereby form a stable dispersion of the dye particles, wherein the anionic polymer is selected from the group consisting of polyacrylic acid, a copolymer of acrylic acid, polymethacrylic acid, a copolymer of methacrylic acid, a copolymer of maleic acid, a copolymer of maleic acid monoester, a copolymer of acrylomethylpropanesulfonic acid, carboxymethyl starch, carboxymethyl cellulose, alginic acid and pectic acid, wherein the dye is present in a range of optical density of about 0.05 to about 3.0, wherein the dye is present in an amount of about $1\times10^{-3}$ to about 3.0 gm/m$^2$, and wherein the anionic polymer is present in an amount of 1 to 100% by weight based on the amount of the dye.

2. A silver halide photographic light-sensitive material of claim 1, wherein the dispersed solid form of the dye is dispersed in fine particles with carboxymethyl cellulose.

3. A silver halide photographic light-sensitive material of claim 1, wherein the dye is represented by formulas (I) to (VII):

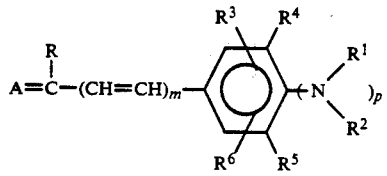

Formula (I)

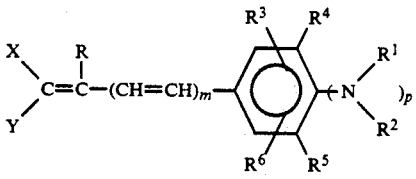

Formula (II)

$A{=}L_1{-}(L_2{=}L_3)_n{-}A'$ Formula (III)

$A{=}(L_1{-}L_2)_{2-q}{=}B$ Formula (IV)

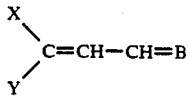

Formula (V)

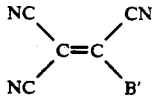

Formula (VI)

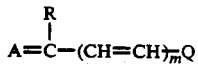

Formula (VII)

wherein A and A' may be the same or different and each represents an acidic nucleus; B represents a base nucleus; X and Y may be the same or different and each represents an electron attractive group; R represents a hydrogen atom or an alkyl group; $R_1$ and $R_2$ may be the same or different and each represents an alkyl group, an aryl group, an acyl group or a sulfonyl group, and $R_1$ and $R_2$ may be combined with each other to form a 5 or 6-membered ring; $R_3$ and $R_6$ may be the same or different and each represents a hydrogen atom, a hydroxy group, a carboxyl group, an alkyl group, an alkoxy group, or a halogen atom; $R_4$ and $R_5$ may be the same or different and each represnts a hydrogen atom or a group of non-metallic atoms necessary for $R_1$ and $R_4$ or $R_2$ and $R_5$ to combine to form a 5 or 6-membered ring; $L_1$, $L_2$ and $L_3$ each represents a methine group; m represents 0 or 1; n and q each represents 0, 1 and 2; p represents 0 and 1, provided that when p is 0, $R_3$ represents a hydroxy group or a carboxyl group and $R_4$ and $R_5$ each represents a hydrogen atom; B' represents a carboxyl group, a sulfamoyl group or a heterocyclic group having a sulfonamidc group; Q represents a heterocyclic group; and provided that the compounds represented by Formulas (I) to (VII) have at least one dissociative group in one molecule, wherein the pKa of the dissociative group ranges from 4 to 11 in a mixed solvent of water and ethanol in a ratio by volume of 1:1.

4. A silver halide photographic light-sensitive material of claim 1, wherein the anionic polymer is selected from the group consisting of polyacrylic acid, a copolymer of acrylic acid, polymethacrylic acid, a copolymer of methacrylic acid, a copolymer of maleic acid, a copolymer of maleic acid monoester, and a copolymer of acrylomethylpropanesulfonic acid.

5. A silver halide photographic light-sensitive material of claim 1, wherein the anionic polymer is selected from the group consisting of carboxymethyl starch and carboxymethyl cellulose.

6. A silver halide photographic light-sensitive material of claim 1, wherein the anionic polymer is selected from the group consisting of alginic acid and pectic acid.

7. A silver halide photographic light-sensitive material of claim 1, wherein the anionic polymer is used in amount of 2 to 30% by weight based on the amount of the dye.

8. A silver halide photographic light-sensitive material of claim 3, wherein a dye of formula (I) is used with carboxymethyl cellulose.

9. A silver halide photographic light-sensitive material of claim 3, wherein a dye of formula (III) is used with carboxymethyl cellulose.

10. A silver halide photographic light-sensitive material of claim 1, wherein the amount is $1\times10^{-3}$ to 1.0 g/m$^2$.

11. A silver halide photographic light-sensitive material of claim 1, wherein the dye is incorporated into hydrophilic colloid of a layer selected from the group consisting of a subbing layer, an anti-halation layer provided between a silver halide emulsion layer and a support, a silver halide emulsion layer, an intermediate layer, a protective layer, a back layer provided on a support on the side opposite from a silver halide emulsion layer, and other auxiliary layers.

12. A silver halide photographic light-sensitive material of claim 1, wherein the dye is incorporated into plural layers.

13. A silver halide photographic light-sensitive material of claim 1, wherein the dye has an average particle size of from 0.16 to 0.39 μm.

* * * * *